United States Patent [19]

Havot

[11] 4,443,805

[45] Apr. 17, 1984

[54] PLATE-TYPE ANTENNA WITH DOUBLE CIRCULAR LOOPS

[76] Inventor: Henri A. P. Havot, 13, rue de la Prée, 35510 Cesson-Sevigne, France

[21] Appl. No.: 329,318

[22] Filed: Dec. 10, 1981

Related U.S. Application Data

[63] Continuation of Ser. No. 96,759, Nov. 23, 1979, abandoned.

[30] Foreign Application Priority Data

Nov. 27, 1978 [FR] France ..... 78 34424

[51] Int. Cl.[3] ..... H01Q 9/26

[52] U.S. Cl. ..... 343/803; 343/807; 343/769

[58] Field of Search ..... 343/200 MS File, 742, 343/747, 769, 803, 804, 807

[56] References Cited

U.S. PATENT DOCUMENTS

| | | | |
|---|---|---|---|
| 4,005,430 | 1/1977 | Dubost et al. | 343/807 |
| 4,015,265 | 3/1977 | Dubost et al. | 343/807 |
| 4,084,162 | 4/1978 | Dubost et al. | 343/807 |

FOREIGN PATENT DOCUMENTS

| | | |
|---|---|---|
| 2119901 | 4/1971 | France . |
| 2311422 | 5/1975 | France . |

*Primary Examiner*—Eli Lieberman

*Attorney, Agent, or Firm*—Laff, Whitesel, Conte & Saret

[57] ABSTRACT

The plate-type antenna is constituted by two tangent circular rings lying in a common plane and interconnected by a slit which is narrow and oriented in the direction of an axis which joins the centers of the rings. The slit extends from the internal edge or circumference of one ring to the internal edge or circumference of the other ring. The tangency zone has a given width which is small as possible in the direction which is perpendicular to the axis of the two rings. One edge of the slit is excited or energized in the immediate neighborhood of the center of symmetry of the antenna. Ground is connected to the middle point of at least one ring located on the axis on the other side of the center. The antennas may be assembled into networks. They may be constructed as double-faced printed circuits.

10 Claims, 6 Drawing Figures

PLATE-TYPE ANTENNA WITH DOUBLE CIRCULAR LOOPS

Figure 1B:
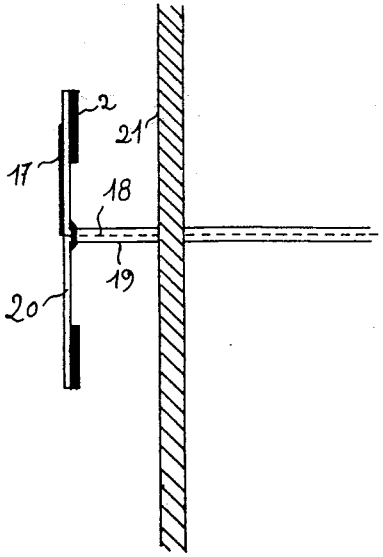

This is a continuation of application Ser. No. 096,759, filed Nov. 23, 1979, now abandoned.

The present invention relates to plate-type antennas with double circular loops.

Loop-type antennas already have been the object of studies. It is known, for example, that it is possible to establish an equivalence between the width of a plate-type antenna and the diameter of the circular strand of the doublet. That equivalence, for example, has been treated in the work of R. W. O. King titled "The Theory of linear antennas" published in 1956 by Harvard University Press, Cambridge, Mass., United States of America. There are also known doublets folded back into a plate with an energized strand, which is much wider than the folded strand.

The object of the present invention is to provide for a clearly different antenna, relative to those known antennas. Another object is to make it possible to obtain distinctly better antenna performances.

According to one characteristic of the invention, a plate-type antenna comprises two tangent circular rings, with a narrow slit oriented along the axis which joins the centers of the rings, and running from the internal edge of one ring to the internal edge of the other ring, in the zone in which they are tangent. The zone has some width in the direction perpendicular to said axis. One edge of the slit is energized in the immediate neighborhood of the center of symmetry of the antenna. The middle point of at least one ring, which is located on the axis on the other side of the center, relative to the tangency point, is connected to the ground.

According to another characteristic of the invention, the antenna is executed by a double face printed circuit. The energization is being obtained by a practically semi-circular conductor the radius of which is approximately the arithmetic mean of the internal and external circles of a ring. One half of the ring serves as a ground level with a first end connected to the energizing point located on the other side of the slit relative to the half ring which serves as ground plane, running under the slit. Its other end is connected, through the insulating sheet of the printed circuit, to the core of a co-axial cable the external conductor of the co-axial cable, is connected to the ground point of the antenna, the co-axial cable being perpendicular to the plane of the antenna.

According to another characteristic, the antenna is completed by a reflecting plane placed behind the antenna, parallel to the plane of, the antenna, with the co-axial cable running through the plane.

According to another characteristic, the point which is symmetrical to the ground point, relative to the center of symmetry of the antenna, is connected to the reflecting plane, which is connected to the mass (ground).

Figure 1A:
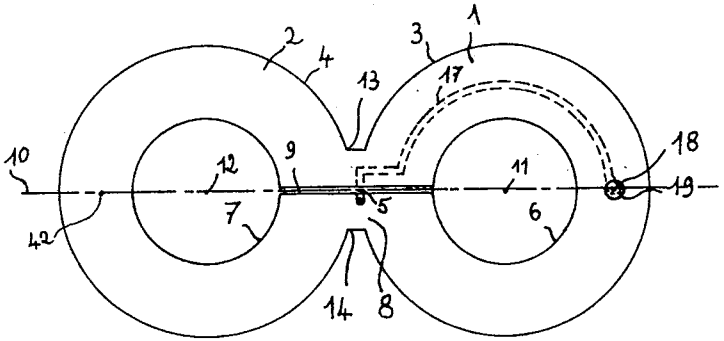
Figure 1C:
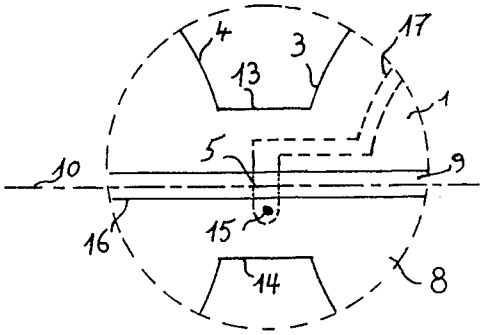
Figure 1D:
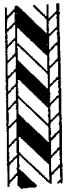
Figure 2:
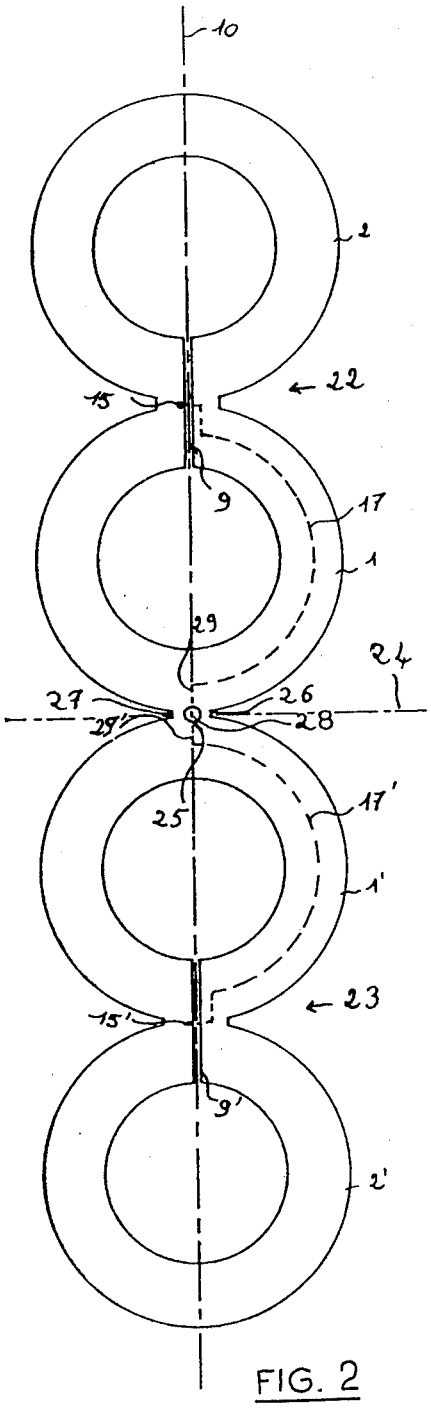
Figure 3:
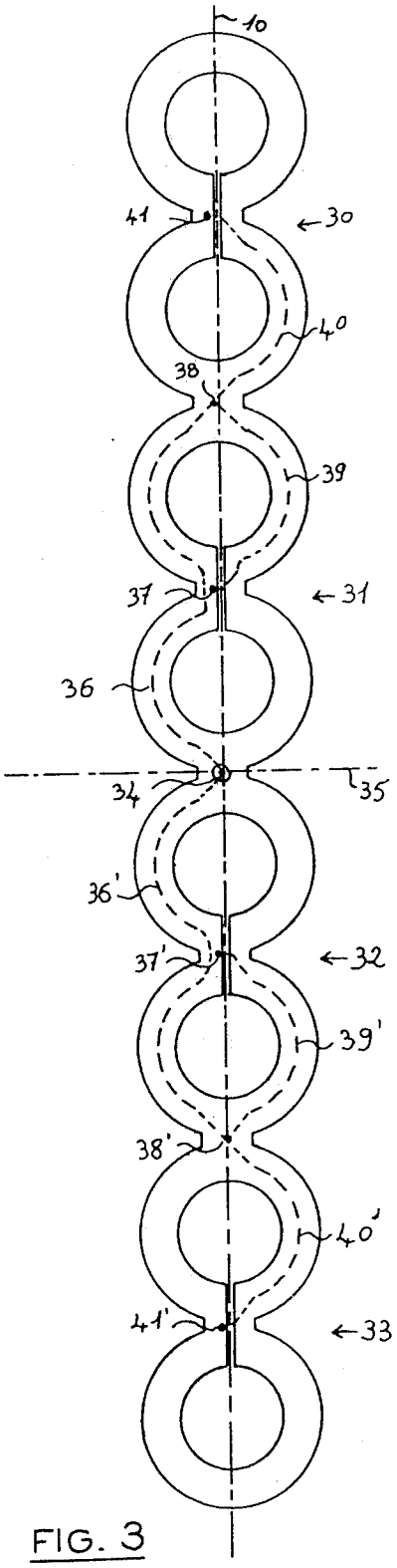

The above characteristics of the invention which have been indicated above, as well as others, will appear more clearly upon reading of the following description of an embodiment, the description being given relative to the attached drawing in which:

FIG. 1*a* is a view of the radiating face of a simple antenna according to the present invention;

FIG. 1*b* is a side view of the antenna in FIG. 1., placed in front of a reflecting plane;

FIG. 1*c* is an enlarged view of a portion of FIG. 1*a* which is identified by a dashed line arrow;

FIG. 1*d* shows a double faced printed circuit board, in cross section;

FIG. 2 is a schematic view of a double antenna according to the present invention; and FIG. 3 is a schematic view of a quadruple antenna, according to the present invention.

The antenna in FIG. 1*a* is constructed as a double face printed circuit (FIG. 1*d*) of epoxy glass ($\epsilon_r$ #4.3) the thickness of which is approximately 0.3 mm. The radiating part of the antenna is constituted by two conductor rings 1 and 2 the external circumferences 3 and 4 are supposed to be tangent at the center of symmetry 5 of the antenna. The two rings 1 and 2 are of rings the same size, that is to say the diameters 3 and of 4 are equal, as are the diameters of the internal circumferences 6 and 7. In zone 8, the rings 1 and 2 are practically tangent. There is a slit 9 oriented along the direction of axis 10, which joins the centers 11 and 12 of the rings. Slit 9 goes from circle 6 to circle 7, that it to say it runs longitudinally through zone 8.

As shown by segments 13 and 14, the large circles 3 and 4 are, in the neighborhood of zone 8, connected together before reaching slit 9. This slit creates an electrical continuity between the two rings on each side of slit 9. Segments 13 and 14 are parallel to axis 10. They are separated from each other by a distance which, practically, is of the order of the width of the rings.

FIG. 1*c* also shows (within a dashed line circle), in larger scale, zone 8 and, especially the energizing point 15 of the antenna which is located on edge 16 of slit 9, across from the center of symmetry 5. At point 15, a conductor runs from the side of the printed circuit having rings 1 and 2, through the insulating sheet to the opposite side where it is connected to one end of an energized conductor (shown by dashed lines) of a banded line 17 which runs under slit 9. This conductor forms an elbow, joins the half-circle shaped median line of half ring 1 located on the other side of axis 10 of the slit 9. Conductor 17 is formed by the conductive layer on the back of the epoxy board. It has its other end located on axis 10 in the middle of the ring, where it is connected to core 18 of a co-axial cable. The core of which runs through the insulating sheet of the printed circuit. The external conductor 19 of co-axial cable is electrically connected to the conducting surface of ring 1.

As shown in FIG. 1*b*, the co-axial cable 19 is perpendicular to the plane of insulating sheet 20 having the printed conductor rings 1 and 2 on one face thereof. On its other face, there is printed conductor 17. FIG. 1*b* shows that the co-axial cable central conductor or core 18 runs through insulating sheet 20, while outer conductor 19 of the co-axial cable is soldered or welded to printed circuit ring 1. Moreover, cable 19 is shown running through a reflecting plane 21, which is parallel to and behind the plane of sheet 20, that is to say of rings 1 and 2. Reflector plane 21, as well as external conductor 19, is connected to ground, this causing small circle 19 in FIG. 1*a* to be connected to the ground. Reflector 21 may be square.

One example of an embodiment of the radiating element in FIGS. 1*a* and 1*b*, has the following dimensions:

| | |
|---|---|
| Outside diameter 3 and 4 of rings 1 and 2 | 5.00 cm |

-continued

| | |
|---|---|
| Inside diameter 6 and 7 | 2.50 cm |
| Width of rings 1 and 2 which constitute the radiating strands | 1.25 cm Or 0.087 m |
| Distance between printed circuitcard 20 and the reflector 21 | 1.50 cm Or 0.105 m |
| Total length | 10.00 cm Or 0.7 m |
| Total width | 5.00 cm Or 0.35 m |
| Width of reflector 21 | 30.00 cm Or 2.1 m |

in which m is the wave length in (vacuum) which corresponds to the minimum frequency of the passing band of the antenna, used during a series of measurements.

The measurements were carried out on the radiating element. The geometric measurements or magnitudes are indicated above, causing the frequency to vary from 2.1 to 3.6 GHz. The stationary wave ratio (R.O.S.) of the antenna with an impedance brought back to 50 ohms remains less than 2.5. It must be noted that it is possible to modify the impedance of a radiating element by causing variations in the width of the radiating strand, that is to say in the width of the rings.

The directivity diagram openings have been measured at 3 dB in the earth planes E, which is perpendicular to slit 9, and is plane H which contains axis 10. The results are recorded in the following table:

f(GHz) 2'1 2'2 2'3 2'4 2'5 2'6 2'7 2'8 2'9 3 3'1 3'2 3'3 3'4 3'5 3'6

Plane H 63° 52° 58° 56° 53° 50° 41° 50° 40° 46° 40° 37° 41° 30° 38° 27°

Plane E 68° 63° 66° 65° 60° 60° 53° 55° 54° 60° 61° 57° 60° 47° 60° 54°

By way of information, the openings of a conventional half-wave doublet placed parallel to a reflector plane separated by one quarter wave are, at 3 dB, respectively $\theta_e = 72°$ L and $\theta_h = 120°$ In addition the radiation diagram of the antenna present only one main lobe, and no secondary lobe in the frequency range under consideration. The directivity, calculated from the diagrams, ranges between 10 dB for the lowest frequencies, and 14.7 dB for the highest frequency. The mean directivity value is, in the middle of the band, higher than 12 dB.

Preferably, the distance between the outside edges of segments 13 and 14 is as small as possible. Indeed, they have a tendency to deform the lobes. However, it is impossible to reduce them below a given limit to make possible the passage of conductor 17 with its elbow, in to zone 8. Preferably, the distance between outside edges 13 and 14 is chosen to be less than the width of the strands, that is to say of the rings. It must be noted that a reduction in the width of the strands (rings) makes it possible to increase the radiation impedance. However, for a given dielectric constant of sheet 20, a reduction of the strands width must be accompanied by a reduction of conductor 17 so that printed circuit conductor 17 will operate under good conditions. Reduction of the strands width, therefore, has a limit from the point of view of practical operations. A reduction of the width of slit 9 has a capacitive effect on impedance.

FIG. 2 shows a network of two radiating elements as shown in FIG. 1, which two elements are aligned along axis 10. The first element 22 comprises, as does the one in FIG. 1, two rings 1 and 2, and the second element 23 comprises two rings 1' and 2' which are respectively symmetrical with rings 1 and 2, relative to a straight line 24 which is perpendicular to axis 10 at the external tangency point of ring 1. Rings 1 and 1' are tangent. Energizing cable 25 ends at the point of axis intersection of 10 and line 24. Its external conductor is soldered or welded to the plates of rings 1 and 2. In practice, around the tangency point of rings 1 and 1', the plate has a given width, in the direction of 24, which is limited by segments 26 and 27. The distance between segments 26, 17 may be smaller than that between segments 13 and 14. Core 28 of co-axial cable 25 is connected, on the other side of the dielectric sheet, to two small segments 29 and 29' which are symmetrical and oriented along 10. Segment 29 is being connected to banded conductor 17, and segment 29' (being connected) to a printed circuit conductor 17' which is symmetrical to printed circuit conductor 17. In addition, there is slit 9 and its symmetrical slit 9', as well as energizing point 15 and its symmetrical point 15'.

Assuming that element 22 has external dimensions identical with those of the element in FIG. 1, it is possible to feed the two element network by means of a cable 25 having a 100 ohms impedance, under condition suitably to choose the width of the strands, that is to say smaller than in the element in FIG. 1.

When carrying out with the antenna in FIG. 2, the same measurements as with that in FIG. 1, there are obtained the following results:

f(GHz) 2'1 2'2 2'3 2'4 2'5 2'6 2'7 2'8 2'9 3 3'1 3'2 3'3 3'4 3'5 3'6

Plane H 31° 26° 24° 27° 22° 27° 21° 25° 23° 22° 23° 18° 23° 16° 20° 16°

Plane E 68° 63° 65° 65° 60° 60° 53° 55° 54° 60° 61° 57° 60° 48° 60° 54°

It is seen that the openings obtained in Plane H, for the same range of frequency as before, range between 16° and 26°, that is to say approximately half the insulated radiating element. It must be noted that, for the frequency of 3.2 GHz, there are obtained secondary lobes which are lower than anticipated, that is to say −20 dB instead of 13.2 dB are generally obtained.

There is also observed that, because of the physical and electrical continuity between the radiating elements around their tangency point, it is possible, especially using a printed circuit line energizing sources, to obtain an extremely simple energizing system with lower losses than in the known networks.

FIG. 3 shows a network of four radiating elements, each element being as in FIG. 1, which constitute two pairs of antennas such as in FIG. 2. That network of FIG. 3 comprises the elements 30, 31, 32 and 33, which are respectively tangent two by two. A co-axial feeding cable 34 is connected to the point of tangency of elements 31 and 32. Its central conductor or core is this time connected to two banded conductors which are symmetrical relative to a straight line 35 which is, perpendicular to axis 10 at the point of tangency between elements 31 and 32. The conductors 36 and 36' also are symmetrical relative to conductors 17 and 17' of the antenna in FIG. 2, and with respect to axis 10, that is to say, they run under the half rings which comprise the point of energizing. In the zone of the slit of radiating element 31, conductor 36 runs at some distance from the energizing point 37 and its extends under the adjacent ring half to reach the point 38 of tangency of elements 30 and 31. There it is divided into two conductors 39 and 40, which are entirely similar to conductors 17 and 17'. The ends of conductors 39, 40 are the energizing point 37 of element 31, and point 41 of element 30. From conductor 36, there are also the symmetrical lines 39' and 40′ which end at the energizing point at 38′ the tangency point of elements 32 and 33, and at the energizing point 41′ of element 33.

It thus appears that the radiating elements according to the present invention makes it possible, in the simple manner, using the technique of printed circuit or banded conductors (as at 17), to execute networks having a large number of elements.

It must moreover be noted, again with reference to the radiating element in FIG. 1*a*, 1*b*, that the point 42 is located on axis 10. Point 18 is symmetrical relative to the tangent which is common to rings 1 and 2. Without any drawbacks, these points may be connected to the ground, that is to say to reflector 21, and that is important for reasons of symmetry. The preceding remarks make it possible to consider the energizing of the elements by means of two co-axial cables, one of them ending at point 18 (FIG. 1*a*) and the other one at point 42, the central conductor or core of the co-axial cable is connected to point 15 by a printed circuit or banded conductor which is symmetrical with conductor 17 under the corresponding half of ring 2. The above remarks may also be profitably used in the antenna in connection with FIG. 3, providing for cables which end at points 38 and 38′.

It must further be noted that the radiating element in FIGS. 1*a* and 1*b* can be used at higher frequencies. Its dimensions having been reduced accordingly, in measurement cavities.

I claim:

1. A plate-type antenna comprising an aligned pair of symmetrical conductive circular rings contiguously lying side-by-side in a common plane with a slit joining two openings formed by the centers of the rings, said slit being oriented to lie in the direction of an axis which joins the centers of the openings, said pair of rings being positioned tangentially to each other with a tangency zone of the rings being narrow in a direction which is perpendicular to said axis, means for energizing one edge of said slit at a point which is near a center of symmetry of the antenna, and means for connecting to ground a middle point of at least one ring located on said axis and on a side of the tangency zone which is opposite said point.

2. The antenna according to claim 1 wherein said antenna is made from a double faced printed circuit board, said pair of rings being printed on one side of said printed circuit board, means for feeding a signal to said point via a substantially semi-circular strip line connector printed on the opposite side of said board, the radius of said semi-circle being approximately the arithmetic means of the inside and outside radius of said ring, the half-ring strip line formed by said semi-circle serving as a ground plane, a first end of said strip line being connected to said energizing point, said point being located on the other end of the slit relative to the location of the half-ring ground plane, from that point, the strip line running under the slit, the other end of said strip line being electrically connected through the insulating sheet of the printed circuit board, to a central conductor of a co-axial cable, the external and shielding conductor of said co-axial connector being connected to the ground of the antenna, said co-axial cable being connected to extend perpendicularlly away from the plane of the antenna.

3. The antenna according to claim 1 or 2 and reflecting plane means behind the antenna, in a position which is parallel to the plane of the antenna, the co-axial cable running through said reflecting plane means, the reflecting plane means being electrically and mechanically connected to the external and shielding conductor of said co-axial cable.

4. The antenna accordng to claim 1 or 2, and means for electrically and mechanically connecting the point which is symmetrical with said ground point, relative to the center of symmetry of the antenna, to the reflecting plane.

5. The antenna according to claim 3, and means for electrically and mechanically connecting the point which is symmetrical with said ground point, relative to the center of symmetry of the antenna, to the reflecting plane.

6. The antenna according to claim 1 or 2, wherein there are a plurality of such antennas, the slits of which being lined up, said antennas being positioned tangentially to neighboring antenna, and means for energizing said antennas via a printed strip line.

7. The antenna according to claim 3, wherein there are a plurality of such antennas, the slits of which being lined up, said antennas being positioned tangentially to neighboring antenna, and means for energizing said antennas via a printed strip line.

8. The antenna according to claim 4, wherein there are a plurality of such antennas, the slits of which being lined up, said antennas being positioned tangentially to neighboring antenna, and means for energizing said antennas via a printed strip line.

9. The antenna according to claim 5, wherein there are a plurality of such antennas, the slits of which being lined up, said antennas being positioned tangentially to neighboring antenna, and means for energizing said antennas via a printed strip line.

10. The antenna of claim 1 wherein each of said pair of circular rings is a relatively wide conductor having a width which is approximately equal to one quarter of its outside diameter.

* * * * *